United States Patent [19]

Ramsay

[11] 4,008,808

[45] Feb. 22, 1977

[54] RAZOR SAFETY RACK

[75] Inventor: Jack D. Ramsay, Duluth, Minn.

[73] Assignee: The Raymond Lee Organization, Inc., a part interest

[22] Filed: Dec. 29, 1975

[21] Appl. No.: 644,738

[52] U.S. Cl. ..... 211/65; 211/88; 248/110; 312/207

[51] Int. Cl.[2] ..... A47B 81/02; A47F 5/08

[58] Field of Search ..... 211/65, 66, 49 D, 49 R, 211/60, 88, 89, 90, 94, 86; 248/110, 111, 113, 309, 310, 311, 316; 312/206, 207; 132/79 R, 80 R; D6/88

[56] References Cited

UNITED STATES PATENTS

| | | | |
|---|---|---|---|
| 1,536,468 | 5/1925 | Behrman | 248/110 |
| 1,697,711 | 1/1929 | Brown | 211/88 |
| 1,915,958 | 6/1933 | Skirrow | 211/88 |
| 2,200,046 | 5/1940 | Straus | 132/80 |
| 2,463,668 | 3/1949 | Wright | 211/65 |
| 2,523,921 | 9/1950 | Pratt | 312/207 |
| 2,888,146 | 5/1959 | Teas, Jr. | 211/86 |
| 3,409,144 | 11/1968 | Bridgman | 211/88 X |
| 3,860,304 | 1/1975 | Bolton | 211/49 D X |
| D148,931 | 3/1948 | Hopkins | D6/88 |

*Primary Examiner*—Roy D. Frazier
*Assistant Examiner*—Terrell P. Lewis

[57] ABSTRACT

A holder for a plurality of safety razors and other bathroom articles is detachably secured to a bathroom wall. The holder includes a horizontally elongated housing having a horizontal shelf and a plurality of recesses beneath the shelf for receiving safety razors of both double edge and single edge types. Catch mechanisms disposed in all of the recesses press against the heads of both double and single edge razors to hold same detachably in these recesses to prevent the razors from being accidentally dislodged therefrom.

3 Claims, 4 Drawing Figures

FIG. 1
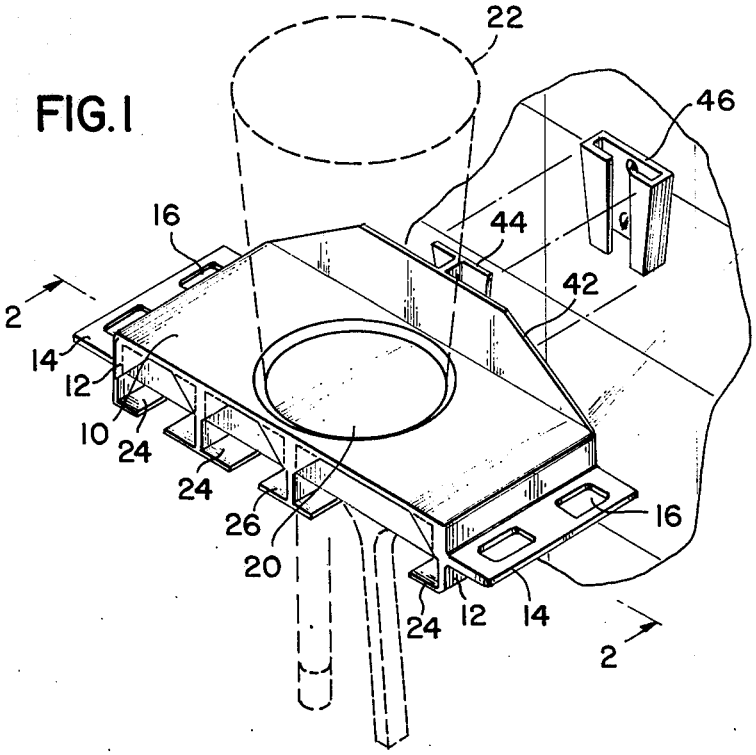
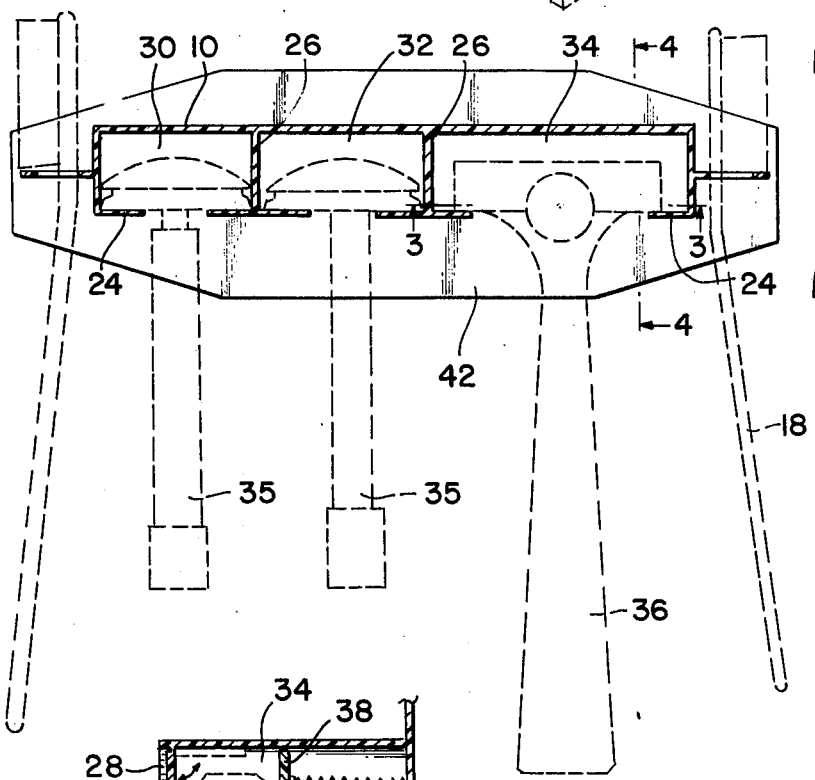
FIG. 2
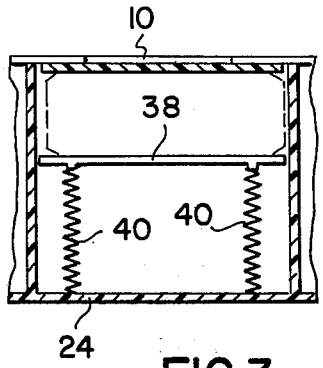
FIG. 3
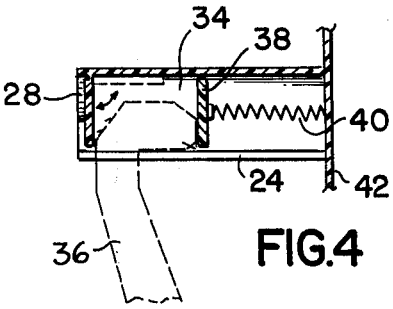
FIG. 4

RAZOR SAFETY RACK

SUMMARY OF THE INVENTION

This invention is directed toward a holder for a plurality of safety razors which can be detachably secured to the wall of a bathroom in such manner that any razor can be removed, used and replaced without disturbing the position of any other razor. This enables a number of different individuals using different razors to store same for use in the one holder.

To this end, the holder includes a horizontal elongated housing having a horizontal shelf. A plurality of recesses are disposed below the shelf, each recess being adapted to receive a razor. Some recesses receive double edge razors. One selected recess receives one or more single edge razors. Catch means disposed in these recesses press against the heads of the razors.

The holder can also be adapted to receive and hold other bathroom articles such as toothbrushes and drinking glasses.

BRIEF DESCRIPTION OF THE DRAWINGS

FIG. 1 is a perspective view of the invention;
FIG. 2 is a view taken along line 2—2 in FIG. 1;
FIG. 3 is a view taken along line 3—3 in FIG. 2; and
FIG. 4 is a view taken along line 4—4 in FIG. 2.

DETAILED DESCRIPTION OF THE DRAWINGS

Referring now to FIGS. 1–4, a horizontally elongated shelf 10 has a shoulder 12 at each end terminating in a horizontal flange 14 having openings 16 detachably accommodating toothbrushes 18 or the like. A top centrally disposed recess 20 in shelf 10 can support removable drinking glass 22.

The bottom edges of shoulders 12 extend below flanges 14 and terminate in horizontally inwardly extending lips 24. Spaced vertical walls 26 parallel to flanges 14 extend downward from the bottom of the shelf, each wall having two oppositely disposed horizontal lips 24 coplanar with other lips 24. Each shoulder has an inwardly disposed inclined brace 28. Each wall 26 has two oppositely disposed inclined braces 28.

As a result recesses 30, 32 and 34 are formed. Each of recesses 30 and 32 can support, removably, a corresponding double edge razor 35. The razors 35 are supported, by their heads, by the lips and braces. The heads of these razors 34 are disposed side by side and extend in a common horizontal direction.

The third recess 34 supports, removably, one or more single edge razors 36. Plate 38 presses upwardly against the bottom of the head of razor 36 to hold same in position. Plate 38 is pressed upward by spaced vertical coil springs 40. The head or heads of razor or razors 36 extends horizontally at right angles to the heads of the other razors.

The front openings of each of recesses 30, 32 and 34 each have a trapezoidal shape with a trapezoidally shaped flap hingedly secured at its top horizontal edge in the opening to close it. One such flap 48 with its hinge 50 is shown in FIG. 4. All other flaps function in the same manner with like type hinges.

A vertical plate 42 secured to the rear edge of shelf 10 carries fitting 44 detachably engagable with fitting 46 secured to the vertical wall of the bathroom to hold the structure in place. The holder can be formed of plastic, wood, metal or any other suitable material.

While the invention has been described with particular reference to the drawings, the protection sought is to be limited only by the scope of the claims which follow.

What is claimed is:

1. A holder for a plurality of safety razors and other bathroom articles comprising:
   - a horizontally elongated housing having a plurality of recesses underneath a shelf, some of said recesses receiving safety razors of the double-edge type and at least one recess receiving razors of single-edge type;
   - two horizontal, opposed flanges, each flange being located on a corresponding end of the shelf and bearing a plurality of holes through which toothbrush handles may be placed;
   - a spring-loaded plate located in the said one recess for receiving single edged razors;
   - catch means located in the said some recesses for pressing against the head of double edge razors placed therein to retain the razors removably in the recesses and thereby prevent them from being accidently dislodged therefrom; and
   - mounting means detachable securing the housing to a vertical wall.

2. The holder of claim 1 wherein said recesses are so disposed that the heads of the double razors extend horizontally in the same direction and are disposed side by side and the single edge razors have heads which extend horizontally in a second direction disposed at right angles to said same direction.

3. The holder of claim 2 wherein said shelf has a recess in its top surface for supporting a removable glass.

* * * * *